United States Patent [19]

Kern

[11] 4,011,933

[45] Mar. 15, 1977

[54] RIBBON DRIVE MEANS

[75] Inventor: Jack L. Kern, Arlington, Tex.

[73] Assignee: Xerox Corporation, Stamford, Conn.

[22] Filed: Oct. 3, 1975

[21] Appl. No.: 619,547

[52] U.S. Cl. ..... 197/151

[51] Int. Cl.[2] ..... B41J 33/26

[58] Field of Search ..... 197/151–168; 242/55.17, 199

[56] References Cited

UNITED STATES PATENTS

| | | | |
|---|---|---|---|
| 3,311,316 | 3/1967 | Williams | 242/55.19 |
| 3,804,227 | 4/1974 | Cappotto et al. | 197/151 |
| 3,814,231 | 6/1974 | Cappotto | 197/168 |
| 3,830,351 | 8/1974 | Cappotto | 197/151 X |
| 3,854,804 | 12/1974 | McMaster | 242/199 X |
| 3,897,866 | 8/1975 | Mueller | 197/151 |

*Primary Examiner*—Edgar S. Burr
*Assistant Examiner*—Paul T. Sewell

[57] ABSTRACT

A ribbon drive device comprising a drive roller cooperating with a floating-type idler ring or roller pivoting and rotating about a support post to provide a nip therebetween through which the ribbon is moved upon rotation of the drive roller. The ribbon passes around the floating-type idler ring, through the nip and around the drive roller. The force on and the tension in the ribbon pulls and pivots the floating idler ring into a wedging position between the support post and the cooperating portion of the drive roller, with the ribbon pinched therebetween.

10 Claims, 4 Drawing Figures

RIBBON DRIVE MEANS

BACKGROUND OF THE INVENTION

This invention relates in general to web drive mechanisms and in particular to a ribbon drive mechanism for ink ribbons employed in a ribbon cartridge in serial printer applications.

Although the invention is applicable to various web, tape, strand and ribbon-like materials, it has been found particularly useful in the environment of ink ribbons as used in serial printers. Therefore, without limiting the meaning of the word "ribbon", the invention will be described in this environment.

In devices in which any web material is to be delivered or transferred from a rotatable reel, drum, spool, spindle or a like receptacle to another similar and compatible receptacle, it is normally necessary to provide a web drive means by which force is applied to the web material to remove it from the receptacle providing the supply of web material. Also, normally a web tension means is provided for maintaining a certain amount of tension in the web material during its transfer. Tension in the web material during the transfer is desired for economic reasons and user acceptance so that a greater amount of web material may be placed on each receptacle and so the web material will be tightly wound on the receiving receptacle and will not fall therefrom during handling. In addition, web take-up drive means for the take-up receptacle is required to provide the force necessary to place the web material on the receiving receptacle upon its deliverance from the supply receptacle. In some instances, the web drive means and the web take-up drive means comprises a single means, which performs both functions.

In the particular environment of ink ribbons employed in ribbon cartridges in serial printers, a certain amount of tension in the ribbon is required for proper ribbon feed and ribbon location at the printing position to assure acceptable print quality of the printed material. Ribbon drive means provides the force to move the ribbon the desired amount between successive print operations. The amount of ribbon movement is dependent upon the particular pitch and type of ribbon being used.

It is well known in the art to provide a drive roller with pointed projections thereon in conjunction with spring means for applying the ribbon drive force to the outer periphery of the ribbon wound on the take-up spool as disclosed in U.S. Pat. No. 3,604,549. It is also known to provide a pawl and ratchet arrangement for rotating the spindles, which rotatably support the ribbon supply spool and the ribbon take-up spool as disclosed in U.S. Pat. No. 3,346,090. In U.S. Pat. No. 3,528,536, a drive roller and a friction or pressure roller in conjunction with spring means is disclosed to provide the ribbon drive force.

Such prior art solutions have utilized complex mechanical means in conjunction with spring means to provide the necessary control of the drive means to transfer the web or ribbon material from the supply spool to the take-up spool.

With the prior art in mind, it is an object of the present invention to provide an improved ribbon drive means, which is compatible with cartridges of the present type.

Another object of this invention is to provide a cost effective ribbon drive means for ink ribbons contained in cartridges along the presently described vane.

Other objects and advantages of this invention will be evident from the specification and claims in conjunction with the accompanying drawing illustrative of the invention.

SUMMARY OF THE INVENTION

In accordance with the principles illustrative of this invention, the foregoing objects and others of the present invention are accomplished by a ribbon drive means comprising a drive roller, a floating-type idler ring or roller and a support post cooperating with the floating idler ring with said support post being located in a position whereby a nip is formed between the drive roller and the floating idler ring. The ratio of the outside diameter of the floating-type idler ring to its inside diameter is approximately 1.1 to 1. The support post around which the floating idler ring moves has an outside diameter, which is approximately one-half the diameter of the inside opening of the floating-type idler ring. The ribbon, in one portion of its path of travel from the ribbon supply means to the ribbon take-up means, passes around the floating-type idler ring, through the nip formed between the floating idler ring and the drive roller and then around the drive roller. As the drive roller is advanced by the ribbon drive motor, the ribbon is advanced and in so doing, the force on and the tension in the ribbon pulls and pivots the floating idler ring into a wedging position between the support post and the cooperating portion of the drive roller with the ribbon pinched therebetween. The harder the ribbon is pulled, the greater the wedging or pinching force against the ribbon becomes and as the drive roller is rotated by external means, the ribbon is transported through the nip and on to the ribbon take-up means.

BRIEF DESCRIPTION OF THE DRAWING

Other advantages and features of the present invention may become more apparent from reading the following detailed description in connection with the drawing forming a part thereof, in which.

DESCRIPTION OF THE PREFERRED EMBODIMENT

Figure 1:
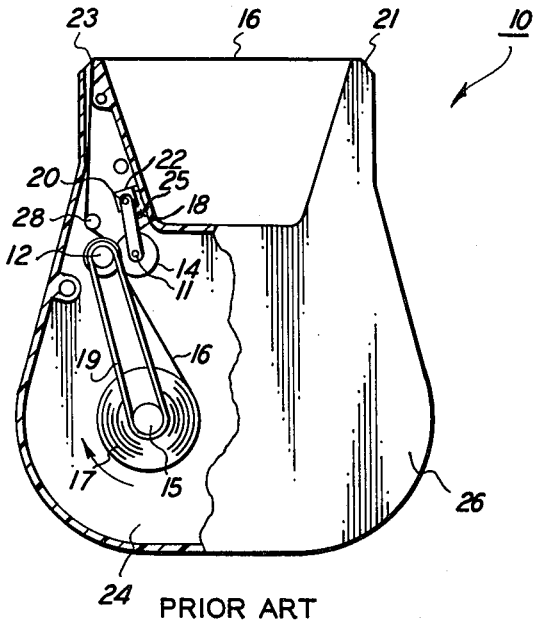
FIG. 1 is a fragmentary top plan view showing a ribbon cartridge constructed in accordance with the prior art.

The prior art ribbon drive means employed in the ribbon cartridge 10 of FIG. 1 comprises drive roller 12 cooperating with an idler pressure roller 14 to form a gripping and rolling action with respect to ribbon 16 passing through the nip formed therebetween. Both the drive roller 12 and the idler pressure roller 14 have teeth or serrations formed on the outer surface of their coacting portions. Drive roller 12 is journaled for rotation in opposing holes in alignment with each other in the bottom cover portion 24 and the top cover portion 26 of ribbon cartridge 10. A flange near the bottom end of drive roller 12 maintains said roller within the ribbon cartridge 10.

Idler pressure roller 14 is journaled for rotation about pin 11, which is supported in one end portion of levers 18 (only one lever being shown since the other lever is directly behind and on the opposite side of roller 14 from the lever which is shown). The other and opposite end portions of levers 18 are supported for pivotal movement about and by pin 20, which is supported by post 22. Spring 25 urges levers 18 in a clockwise direction resulting in the idler pressure roller 14 being forced and held against ribbon 16 passing between the idler pressure roller 14 and the drive roller 12. A star-type or cross-shaped coupling is formed in the bottom end portion of drive roller 12 to mate with the drive shaft of the ribbon drive motor (not shown), which is mounted on the movable carriage (not shown). Guide post 28 projects upwardly in a vertical orientation from the bottom cover portion 24 and is positioned in a location, which provides a constant angle of feed of the ribbon into the nip formed by the drive roller 12 and the idler pressure roller 14.

The ribbon take-up receptacle comprises shaft 15 with integral hub 17 about which the ribbon 16 is wound subsequent to passing beyond the ribbon drive means. Shaft 15 includes a cylindrical opening (not shown) for receiving in relatively rotatable relation a fixed shaft (not shown) projecting upwardly from the bottom cover portion 24. Shaft 15 extends through an opening in the top cover portion 26 with an annular groove formed in the portion of the shaft extending above the top cover portion. O-ring 19 fits into the annular groove in shaft 15 and extends in a stretched condition to a similar groove formed in the top portion of drive roller 12, which extends above the top cover portion 26.

Regarding ribbon path, the ribbon 16 passes from the ribbon supply means (not shown) located in the right-hand portion of ribbon cartridge 10 and out an opening in horn 21, across the open space between horns 21 and 23 and then into an opening in horn 23. Once back inside the ribbon cartridge 10, the ribbon 16 passes around and outboard of guide post 28 and then into the nip formed by drive roller 12 and idler pressure roller 14. From said nip, ribbon 16 passes to and around hub 17 upon which it is wound.

In operation, the ribbon drive means intermittently pulls the ribbon 16 from the ribbon supply means (not shown) thereby providing a fresh portion of ribbon 16 at the print station (located approximately midway between horns 21 and 23) for the printing operation. Upon initiation of a print command for the printer, the ribbon drive motor (not shown) is activated causing the drive roller 12 to rotate. Idler pressure roller 14 is biased toward the drive roller 12 by spring 25 causing a gripping of the ribbon 16 and subsequent movement of the ribbon toward the ribbon take-up receptacle by the rotation of the drive roller 12. The ribbon 16, which is fed through the ribbon drive means, must be wound upon hub 17. This is accomplished by O-ring 19 because it couples the movement of the drive roller 12 to shaft 15 and integral hub 17. As drive roller 12 is rotated to feed ribbon toward hub 17, the hub is correspondingly rotated due to O-ring 19 to take up any slack in the ribbon 16 and wind the ribbon onto hub 17. As the diameter of the wound ribbon 16 on the hub 17 increases, the O-ring is designed to start slipping about shaft 15, thereby permitting hub 17 to rotate at the necessary slower rate. This relationship permits the use of a mechanically simple and inexpensive slip drive mechanism for the ribbon take-up receptacle. As previously noted, drive roller 12 extends above the top cover portion 26, thereby allowing the drive roller to be manually rotated.

Although the above described prior art ribbon drive means operates satisfactorily, it is relatively complicated and expensive. It is complicated from the viewpoint of consisting of numerous small parts, which must be individually fabricated and then be assembled by hand in the ribbon cartridge 10. It is expensive because of the number of parts involved and because of the time in labor involved in assembling the numerous parts in the ribbon cartridge by hand rather than by machine. Because of the particular configuration of support and biasing of idler pressure roller 14, it is possible for tolerances and wear associated with pins 11 and 20 and levers 18 to cause a twisting or cocking of idler pressure roller 14 and thereby lower the efficiency and reliability of the ribbon drive means.

Figure 2:
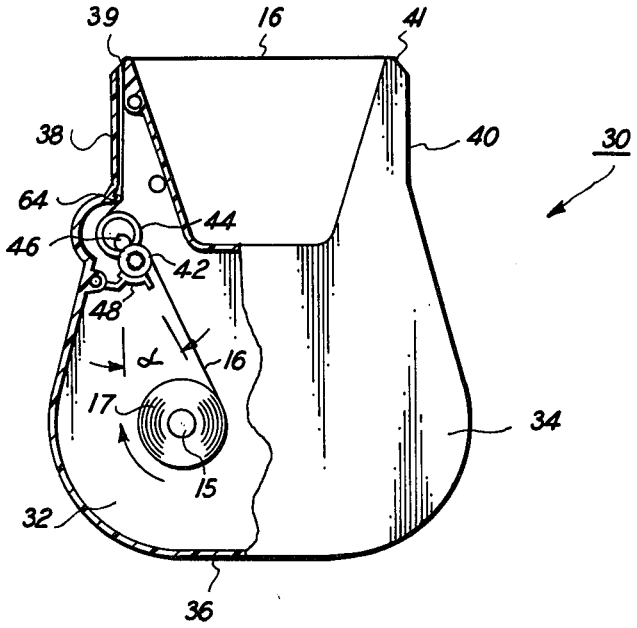
FIG. 2 is a fragmentary top plan view showing a ribbon cartridge constructed in accordance with the teachings of the present invention.
Figure 3:
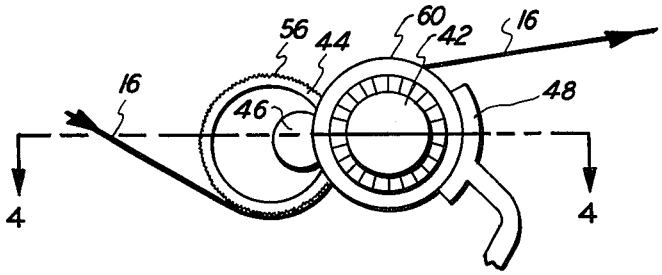
FIG. 3 is an enlarged portion of the present invention shown in FIG. 2.
Figure 4:
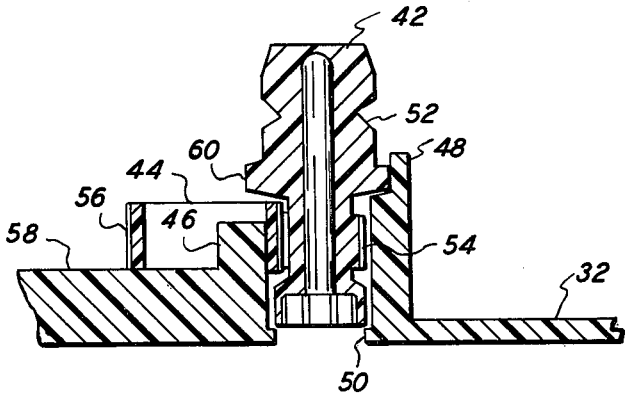
FIG. 4 is a cross-sectional view of FIG. 3 taken along lines 4—4.

FIGS. 2–4 represent a solution according to the instant invention, which provides for the elimination of the possible disadvantages set forth supra.

Referring now to FIG. 2, there is shown one embodiment of the ribbon drive means of the present invention in the ribbon cartridge 30. Ribbon cartridge 30 is mounted and carried by a carriage (not shown), which is mounted for linear movement transversely of a platen (not shown) for cooperating with a print mechanism (not shown) to provide printing capability in serial printer applications. Ribbon cartridge 30 comprises a bottom cover portion 32, a top cover portion 34 and a sidewall connecting portion 36. The ribbon cartridge 30 is desirably manufactured of a light weight, durable material, such as plastic since it is relatively inexpensive and can be easily molded. Two extensions or horns 38 and 40 contain openings 39 and 41 through which the ribbon 16 passes in its path of travel by the printing station located midway between horns 38 and 40.

With reference to FIGS. 2–4, the ribbon drive means comprises drive roller 42, a floating-type idler ring or roller 44, a support post 46 about which the idler ring 44 moves and rotates, and a support rib 48. The lowermost portion of drive roller 42 is journaled for rotation in opening 50 of the bottom cover portion 32 of ribbon cartridge 30. On the upper portion of drive roller 42, an extended ring-type section 60 is journaled for rotation with respect to support rib 48 and an annular groove 52 is formed in the upper portion above the journaled section. On the section between the two journaled portions of drive roller 42, teeth or serrations 54 are formed thereon to maintain good frictional contact with the ribbon 16. The outside diameter of the drive roller 42 at the teeth or serrations 54 is about 0.20 inches for the described embodiment.

A star-type or cross-shaped coupling is formed in the bottom end portion of drive roller 42 to mate and cooperate with the drive shaft of the ribbon drive motor (not shown), which is mounted below the ribbon cartridge 30 on the movable carriage (not shown).

The floating-type idler ring 44 comprises a thin-walled ring whose height is approximately equal to the width of the ribbon. The ratio of the outside diameter of the idler ring 44 to its inside diameter is approximately 1.1 to 1. Teeth or serrations 56 are formed on the outer periphery of the idler ring 44 to maintain good frictional contact with the ribbon 16. The outside diameter of the idler ring 44 is approximately 0.48 inches with an inside diameter of approximately 0.43 inches for the described embodiment. The height of idler ring 44 is about 0.24 inches. Idler ring 44 is positioned to move or rotate around support post 46. The outside diameter of support post 46 is approximately one-half the diameter of the inside opening of idler ring 44 and for the described embodiment the outside diameter is approximately 0.20 inches. The vertical centerline of the support post 46 may be positioned at a known distance from the vertical centerline of the drive roller 42 such that the serrations 54 on the drive roller 42 and the serrations 56 on the outer diameter of idler ring 44 just lightly contact opposite sides of the ribbon 16 placed therebetween so as to pinch the ribbon therebetween. Also, the vertical centerline of the support post 46 may be positioned at a known distance from the vertical centerline of the drive roller 42 such that the serrations 54 on the drive roller 42 and the serrations 56 on the outer diameter of idler ring 44 lightly touch and just intermesh when the ribbon is not placed between the roller and ring. The preferred location of the support post 46 is the latter of the above noted positions.

The support post 46 is positioned along a line, which is drawn through the vertical centerline of drive roller 42 and forms an angle $\alpha$ with an extension of a line formed by the ribbon 16 in its path of travel upon entering the cartridge 30 through opening 39 and moving to the ribbon guide post 64; said angle $\alpha$ is critical for proper and reliable operation of the present invention. The optimum angle for $\alpha$ is about 35°. An extension or platform 58 of the bottom cover portion 32 is formed in the area near support post 46 to support the idler ring 44 at substantially the same vertical level as the ribbon 16 and the serrations 54 formed on drive roller 42.

Support rib 48 projects upwardly from the interior surface of the bottom cover portion 32 and is positioned and shaped to support the drive roller 42 in a vertical position. Drive roller 42 must be maintained in a vertical position to insure correct alignment and relationship with respect to idler ring 44 for proper application of drive force to the ribbon 16 to remove ribbon 16 from the ribbon supply means (not shown) and pass ribbon 16 toward the ribbon take-up means. The support and contact provided to the drive roller 42 by support rib 48 covers an angle of approximately 90°.

Ribbon guide post 64 is positioned between idler ring 44 and opening 39 in horn 38 to provide and assure that ribbon 16 contacts the idler ring 44 at a proper and constant angle and at a point approximately 180° around the outside surface of ring 44 from the nip area.

The ribbon take-up receptacle comprises shaft 15 with integral hub 17 about which the ribbon 16 is wound subsequent to passing beyond the ribbon drive means. Shaft 15 includes a cylindrical opening (not shown) for receiving in relatively rotatable relation a fixed shaft (not shown) projecting upwardly from the bottom cover portion 32. Shaft 15 extends upwardly through an opening in the top cover portion 34 with an annular groove formed in the portion of the shaft 15 extending above the top cover portion. Said annular groove is similar to annular groove 52 formed in drive roller 42. An O-ring (not shown but similar to O-ring 19 depicted in FIG. 1) fits into the annular groove in shaft 15 and extends in a stretched condition to the annular groove 52 in drive roller 42; this O-ring causes a pulling force on the upper portion of drive roller 42, which results in the extended ring-type section 60 being forced against support rib 48.

Regarding ribbon path with reference to FIG. 2, the ribbon 16 passes from the ribbon supply means (not shown), past the ribbon tensioning means (not shown), both of which are located in the right-hand portion of ribbon cartridge 30, out opening 41 and across the open space between horns 40 and 38 and then into opening 39 in horn 38. Once back inside ribbon cartridge 30, ribbon 16 is directed to the inboard side of and contacts said side of ribbon guide post 64. From guide post 64, the ribbon 16 travels to and contacts the outboard section of idler ring 44 at a point approximately 180° around the ring from the nip area, then passes around idler ring 44 and into the nip between idler ring 44 and drive roller 42. From the nip, ribbon 16 passes around the inboard section of drive roller 42 and on to and around hub 17 upon which it is then wound.

In operation, upon initiation of print commands for the printer, the ribbon drive motor (not shown) is activated causing the drive roller 42 to be intermittently rotated in a clockwise direction. With particular reference to FIG. 3, the clockwise rotation of drive roller 42 tends to force ribbon 16 toward the right while the ribbon tensioning means (not shown) tends to place a force on the ribbon 16 in the opposite direction. These two mentioned forces on ribbon 16 cause the idler ring 44 to pivot in a clockwise direction about the nip formed between the drive roller 42 and the idler ring 44 and at the same time the movement of the ribbon 16 in a direction to the right toward the ribbon take-up means will cause the idler ring 44 to revolve in a counterclockwise direction. There appears to be a wedging action occurring between the idler ring 44 and the drive roller 42 as a result of the forces applied to the idler ring 44 from the ribbon 16 and the support post 46. The wedging action results in a pinching or gripping action against ribbon 16 by serrations 56 on idler ring 44 and by serrations 54 on drive roller 42 in the nip area to provide a positive and reliable action, without any slippage, to move the ribbon 16 toward the ribbon take-up means. It seems to be a self-activating wedging action since the greater the value of the forces, the tension force and the driving or pulling force, acting on the ribbon, the greater is the wedging action of idler ring 44 and the greater the pinching or gripping action becomes against the ribbon for its subsequent/simultaneous movement. The angle and location at which the ribbon 16 contacts the outer periphery of idler ring 44 with respect to its over-all path of travel, the location of support post 46 with respect to the nip and the inside and outside diameter measurements of idler ring 44, as well as the diameter of the support post 46 with respect to the inside and outside diameter measurements of the idler ring 44 are all critical elements in the correct operation of the wedging action of the idler ring 44 and the drive roller 42 to provide the required ribbon drive.

With reference to FIG. 2, the ribbon drive means moves the ribbon 16 toward the ribbon take-up receptacle comprised of shaft 15 with integral hub 17 about which the ribbon 16 is wound. The winding action is accomplished by an O-ring (not shown but similar to O-ring 19 depicted in FIG. 1), which transfers the rotational movement of drive roller 42 to shaft 15 and integral hub 17 to take up any slack in the ribbon 16 occurring after the ribbon passes the ribbon drive means and to wind the ribbon onto hub 17. As the diameter of the wound ribbon 16 on the hub 17 increases, the O-ring is designed to start slipping about shaft 15, thereby permitting hub 17 to rotate at the necessary slower rate. Since drive roller 42 extends above the top cover portion 34, this extension allows the drive roller to be manually rotated when necessary.

The idler ring 44 and drive roller 42 are preferably molded out of a plastic material that is somewhat resilient, such as acetal or "DELRIN" (Trademark of E. I. du Pont de Nemours & Co.) resins.

In view of the foregoing, it will be appreciated that this invention provided a ribbon drive means, which may be used to advantage in ribbon cartridges and which is self-compensating for wear associated therewith.

Although the present invention has been described with reference to a presently preferred embodiment, it will be appreciated by those skilled in the art that various modifications, alternatives, variations, etc., may be made without departing from the spirit and scope of the invention as defined in the appended claims.

What is claimed is:

1. In a ribbon cartridge having a top cover section, a bottom cover section, a sidewall connecting section, a ribbon supply means, a ribbon tension control means, and a ribbon take-up means, the improved ribbon drive means comprising:

a rotatably supported drive roller;

a ring containing an inside opening;

a post positioned within the inside opening of the ring, the post further positioned in such proximity to the drive roller that a nip is formed between an outside surface of the ring and an outside surface of the drive roller;

said post having a predetermined diameter sufficiently less than a predetermined diameter of the inside opening of the ring to permit the ring to pivotally move with respect to the nip as well as rotate in cooperation with the drive roller;

said ribbon, as it passes from the ribbon supply means to the ribbon take-up means, passes around a predetermined portion of the outside surface of the ring and then through the nip, whereby said ribbon, upon rotation of the drive roller, causes the ring to pivot with respect to the nip causing a wedging action between the ring and the drive roller at the nip and against the ribbon at the nip, with the rotational movement of the drive roller and the ring cooperating to advance the ribbon through the nip.

2. The improvement of claim 1 wherein said ribbon drive means includes guide means positioned for guiding the ribbon to contact the outside surface of said ring at a point approximately 180° around said outside surface from said nip.

3. The improvement of claim 2 wherein said post is positioned along a first line, which first line forms an angle of approximately 35° with a second line formed by the path of travel of the ribbon between a point of entry of the ribbon to the ribbon cartridge and a point of contact of the ribbon with said guide means.

4. The improvement of claim 2 wherein said guide means comprises a single post member projecting upwardly from the bottom cover section.

5. The improvement of claim 1 wherein said ring has an outside diameter and an inside diameter whose ratio is approximately 1.1 to 1.

6. The improvement of claim 1 wherein said ring has a height approximately equal to the width of the ribbon.

7. The improvement of claim 1 wherein said ring has serrations formed in the outside surface area.

8. The improvement of claim 1 wherein said drive roller has serrations formed in the outside surface area of the roller forming one portion of the nip.

9. The improvement of claim 1 wherein said post has an outside diameter, which is approximately one-half the diameter of the inside opening of said ring.

10. The improvement of claim 1 wherein said ribbon drive means includes means for coupling said drive roller to said ribbon take-up means in order to rotate said take-up means in the appropriate direction and at the appropriate speed to take up the ribbon fed through said nip.

* * * * *